US007636949B1

(12) United States Patent
Shooshan

(10) Patent No.: US 7,636,949 B1
(45) Date of Patent: Dec. 29, 2009

(54) CRAFT APRON

(76) Inventor: Mary E. Shooshan, 6 Grove St., Onset, MA (US) 02558

( * ) Notice: Subject to any disclaimer, the term of this patent is extended or adjusted under 35 U.S.C. 154(b) by 0 days.

(21) Appl. No.: 12/321,845

(22) Filed: Jan. 26, 2009

(51) Int. Cl.
*A41D 13/04* (2006.01)

(52) U.S. Cl. ..... 2/48; 2/51

(58) Field of Classification Search ..... 2/48, 2/51, 52, 46, 47, 49.1, 49.2, 94, 102, 247, 2/338, 248, 250–254; D2/860–864; 224/660, 224/663, 677, 681, 223, 235, 575, 578; 383/4, 383/39, 40, 75
See application file for complete search history.

(56) References Cited

U.S. PATENT DOCUMENTS

| | | | | | |
|---|---|---|---|---|---|
| 191,914 | A | | 6/1877 | Beausoleil | |
| 367,996 | A | * | 8/1887 | Nathan | 224/677 |
| 1,863,527 | A | | 6/1932 | Stern | |
| 2,263,538 | A | | 11/1941 | Freirich | |
| 2,317,176 | A | * | 4/1943 | Byrd | 2/48 |
| 2,364,258 | A | * | 12/1944 | Wallace | 2/92 |
| 2,466,208 | A | * | 4/1949 | Chanslor et al. | 2/48 |
| 2,616,598 | A | | 11/1952 | Sexton | |
| 2,697,465 | A | * | 12/1954 | Johnson | 383/4 |
| 2,710,639 | A | * | 6/1955 | Farls | 383/26 |
| 2,785,409 | A | * | 3/1957 | Lackey | 2/51 |
| 2,846,685 | A | | 8/1958 | Ehrich | |
| 2,897,505 | A | | 8/1959 | Lipscomb | |
| D214,983 | S | * | 8/1969 | Knigge | D3/228 |
| 3,967,666 | A | * | 7/1976 | Farrar | 383/7 |
| D257,596 | S | | 12/1980 | Rosenbloom, III | |
| 4,535,878 | A | * | 8/1985 | Grahl | 190/1 |
| D305,827 | S | | 2/1990 | Flowers | |
| 5,259,541 | A | * | 11/1993 | Reese | 224/663 |
| 6,216,933 | B1 | * | 4/2001 | Healy | 224/663 |
| D461,038 | S | | 8/2002 | Gerson | |
| 2002/0088729 | A1 | * | 7/2002 | Urbanski | 206/373 |
| 2004/0060091 | A1 | * | 4/2004 | Katz | 2/48 |
| 2006/0053523 | A1 | * | 3/2006 | McNamara | 2/48 |
| 2007/0028342 | A1 | * | 2/2007 | Chan | 2/48 |

* cited by examiner

*Primary Examiner*—Amy B Vanatta
(74) *Attorney, Agent, or Firm*—Joseph R. Birkner

(57) ABSTRACT

A craft apron for keeping knitting and crocheting components together, for providing easy access to the components by a knitter and a crocheter and for storing and for carrying the knitting and crocheting components. A first member having a pleated portion and a second member having a hem. The second member joined to the first member to define a pouch. A closure disposed on the first member. The closure has a fastener for fastening the closure to the hem for opening and closing the craft apron. A tie cooperating with the hem. The craft apron is adjustable. A width adjustment is provided with a cord lock by gathering the hem; the cord lock cooperating with the tie and a length adjustment is accomplished with a snap fastener. The craft apron may be worn about the waist of a crafter and carried as a tote bag.

20 Claims, 5 Drawing Sheets

CRAFT APRON

FIELD OF THE INVENTION

This invention relates generally to aprons. More particularly, the present invention relates to a craft apron for keeping knitting and crocheting components together, for providing easy access to the components by a knitter and a crocheter and for storing and for carrying the knitting and crocheting components.

BACKGROUND OF THE INVENTION

Crafters such as knitters and crocheters typically carry their craft materials such as yarn, knitting needles, scissors, instructions and the craft project in progress in a bag that is typically placed near to their knitting or crocheting area. The bag used for the above purpose usually is any kind of available bag that haphazardly and in a disorganized manner, randomly holds practically anything with no attention given to the special needs of a crafter. While using such an ordinary bag, when working on a craft project, the craft project itself is usually placed onto a lap of a crafter. However, for example, while sitting in a waiting room working on a knitting project, yarn sometimes rolls off a lap onto an unsanitary floor thereby soiling the yarn as well as embarrassing the crafter. Also, while busily knitting at home and the phone rings, a crafter must madly scramble to collect his or her project, set it down without the needles slipping out or the yarn unraveling onto the rug while picking up unwanted lint and dirt, and rush to answer the phone, only to have it stop ringing before getting to it. It is apparent that this is an inefficient, frustrating and cumbersome way to knit or crochet because there is no way to keep components in order.

The inventor recognized a never before addressed problem and fulfilled a need which overcomes the limitations and issues associated with knitting and crocheting devices and methods.

In view of the above, it was recognized by the present inventor that there is an unfulfilled need for a craft apron that wears like an apron and has a pouch to conveniently hold a project and accessories and can be conveniently carried about.

Accordingly, it becomes clear that there is a great need for a craft apron which overcomes the disadvantages associated with available bags for use as craft project holders. Such a craft apron should be one that is roomy enough to hold and to readily access a craft project, components and accessories; be adjustable to fit all users; closable; easily carried as a tote bag; attractive; allows the skein of yarn to feed without fuzzing or pilling the skein of yarn or the yarn work itself; works as desired; is easy to use and is economically manufactured.

SUMMARY OF THE INVENTION

It is therefore an object of this invention to provide a craft apron which avoids the aforementioned problems of prior art knitting and crocheting devices and methods.

It is another object of this invention to provide a craft apron that allows easy access to the components by a knitter and a crocheter.

It is another object of this invention to provide a craft apron that keeps knitting and crocheting components together and readily available for use.

It is another object of this invention to provide a craft apron for storing knitting and crocheting components.

It is another object of this invention to provide a craft apron that can be readily adaptable for use as a tote bag.

It is another object of this invention to provide a craft apron that is adjustable in width.

It is another object of this invention to provide a craft apron that is adjustable in length.

It is another object of this invention to provide a craft apron that minimizes fuzzing and pilling of yarn.

It is a further object of this invention to provide a craft apron which may be manufactured from readily available materials by conventional manufacturing processes.

It is still a further object of this invention to provide a craft apron that is simple in design, simple to manufacture, low in cost, and is easy and fun to use.

This invention results from the realization that there is a great need for a highly functional craft apron which is worn about the waist and is suitable for use by knitters and crocheters for keeping their project and materials together and close at hand thereby making the knitting and crocheting process more efficient and enjoyable; the resulting invention provides such benefits.

According to a first aspect of the present invention, disclosed is a craft apron comprising a first member having a pleated portion and a second member having a hem. The second member is joined to the first member to define a pouch. A closure is disposed on the first member. The closure has means for fastening the closure to the hem. A tie cooperating with the hem. A means for adjusting a width of the craft apron; the width adjusting means cooperating with the tie and means for adjusting a length of the craft apron.

The second aspect, in accordance with the present invention, is a special case of the first aspect of this invention with additional features further comprising a pocket having at least an outer pocket panel with a low friction material and an inner pocket panel. The pocket disposed on at least an inner panel of a second member.

The third aspect, in accordance with the present invention, is a method for fabricating a craft apron.

DETAILED DESCRIPTION OF ILLUSTRATIVE EMBODIMENTS

Figure 1:
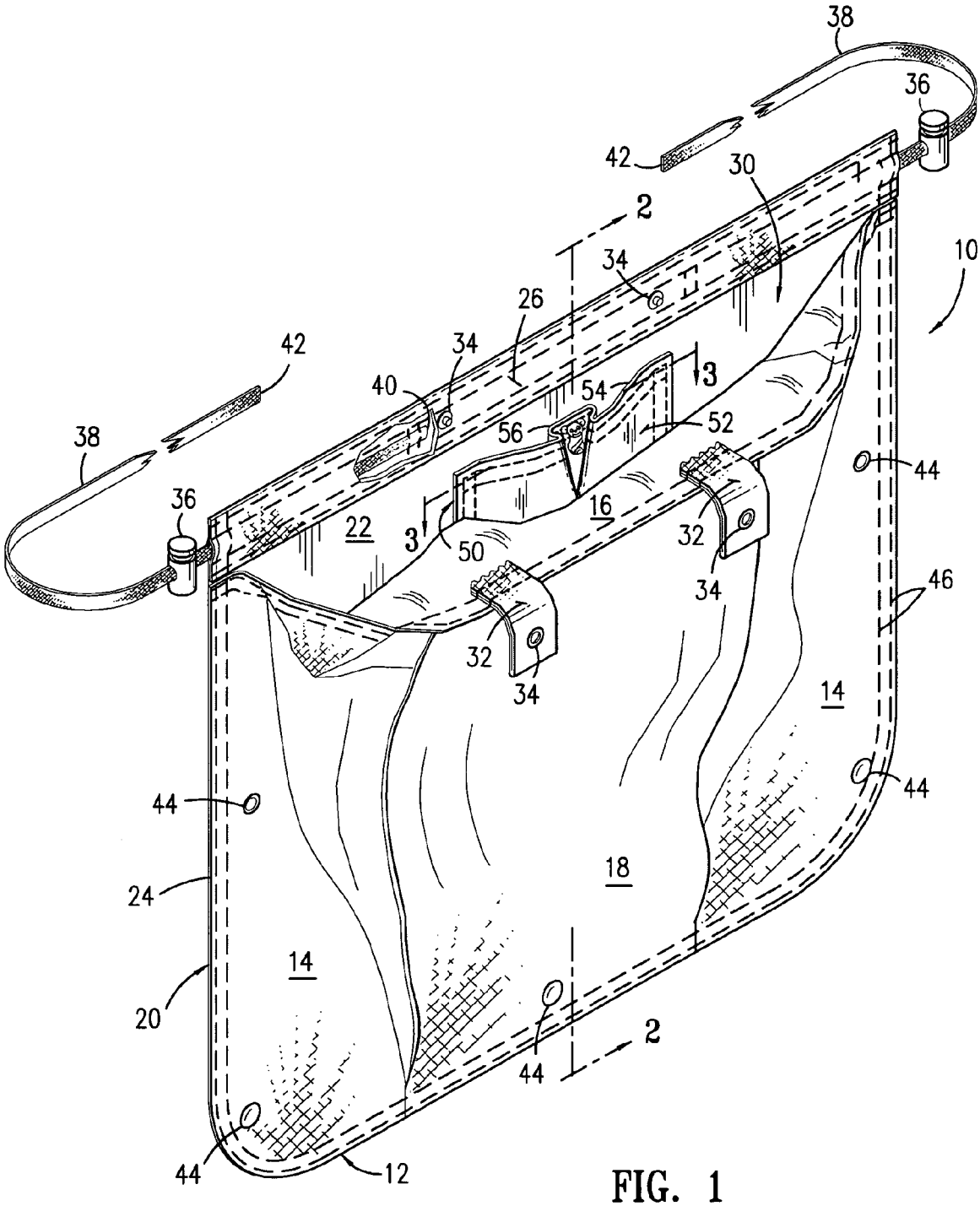
FIG. 1 is a perspective view of an illustrative embodiment of a craft apron of the instant invention shown in an open position.

Looking more particularly to the drawings, there is shown in FIG. 1 an illustrative embodiment of a craft apron, which is generally indicated at 10, according to an embodiment of the present invention.

FIG. 1 is a perspective view of an illustrative embodiment of craft apron 10 of the instant invention shown in an open position. Craft apron 10 comprises a first member 12 having a pleated portion 18 and a second member 20 having a hem 26. Second member 20 is joined to first member 12 by a stitch 46 to define a pouch 30. Preferably, for reinforcement, although not necessary for operation, double stitching is strategically disposed thereon craft apron 10. A closure 32 is disposed on first member 12 and on rear panel 16 and on pleated portion 18. Closure 32 has means for fastening the closure 32 to hem 26 in the form of a fastener 34 for opening and closing the craft apron 10.

A tie 38 cooperating with hem 26; a means for adjusting a width of craft apron 10; the width adjusting means cooperating with tie 38 and means for adjusting a length of craft apron 10 are provided.

First member 12 has a front panel 14, rear panel 16 and pleated portion 18. Second member 20 has an inner panel 22 and an outer panel 24. Preferably, front panel 14 and outer panel 24 are fabricated from a cotton material and rear panel 16 and inner panel 22 are fabricated from a low friction material such as, for example, satin, which allows a skein of yarn to feed without fuzzing or pilling the skein of yarn or the yarn work itself. Selection of a low friction material is critical for desired operation. At least rear panel 16 of first member 12 and at least inner panel 22 of second member 20 are fabricated from a low friction material.

Figure 6:
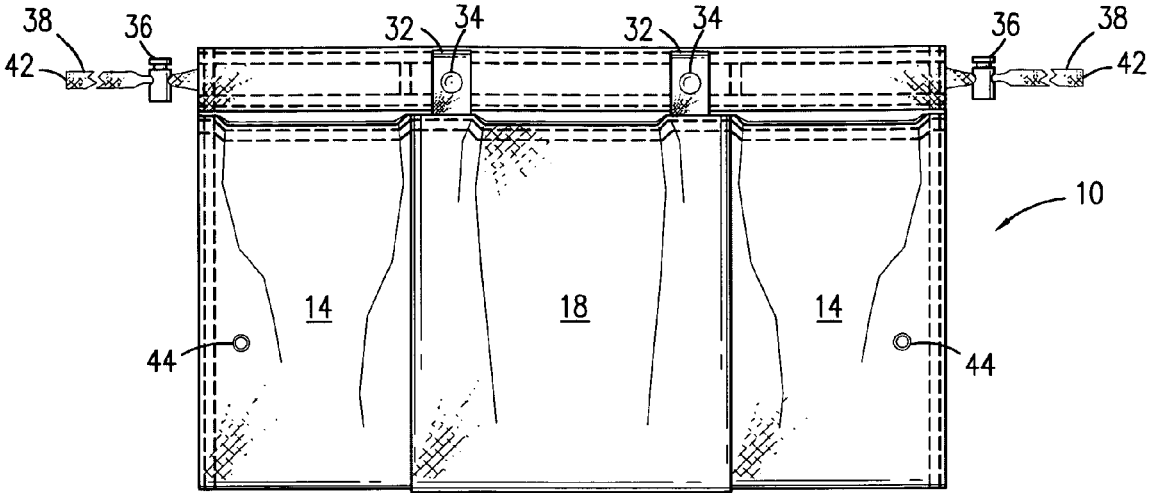
FIG. 6 is a front elevation view of the craft apron of FIG. 4 shown shortened in length.
Figure 7:
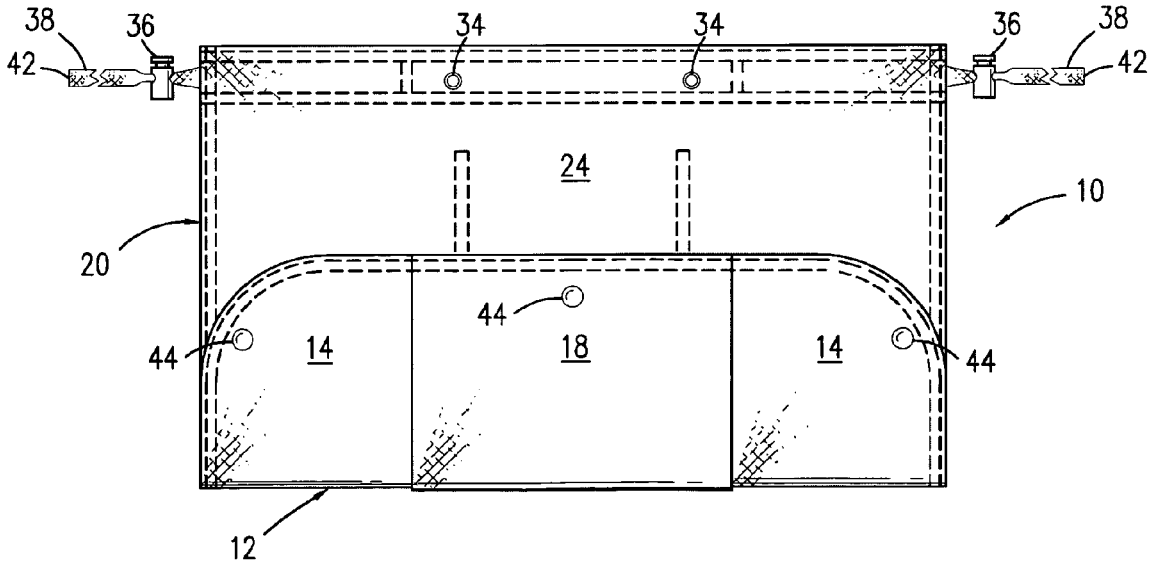
FIG. 7 is a rear elevation view of the craft apron of FIG. 6.

A snap fastener 44 is strategically disposed on first member 12 and on second member 20 for quickly and conveniently adjusting a length of craft apron 10 as best seen in FIGS. 6 and 7. Snap fastener 44 also critically functions as a further reinforcement for keeping first member 12 and second member 20 intact in addition to the stitch 46, thereby making craft apron 10 durable.

Figure 9:
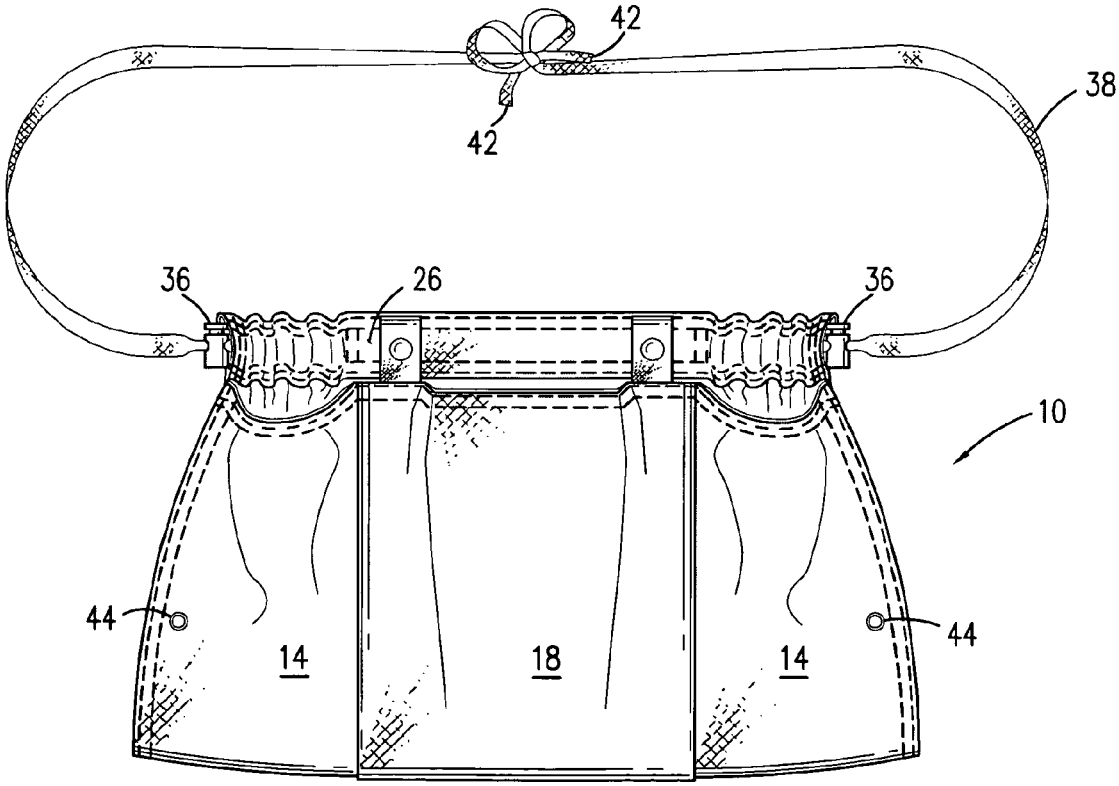
FIG. 9 is a front elevation view of the craft apron of FIG. 8 shown with tie distal ends joined for carrying as a tote bag or for use as an apron worn around a waist of a crafter.

Tie 38 has a proximal end 40 and a distal end 42 and cooperates with hem 26. Proximal end 40 is partially disposed inside a length of hem 26 and fixed therein while distal end 42 is free for joining, for carrying as a tote bag as seen in FIG. 9 or for use as an apron around a waist of a crafter. It is understood, that without departing from this disclosure, proximal end 40 and distal end 42 may freely extend outwardly therefrom hem 26.

Figure 8:
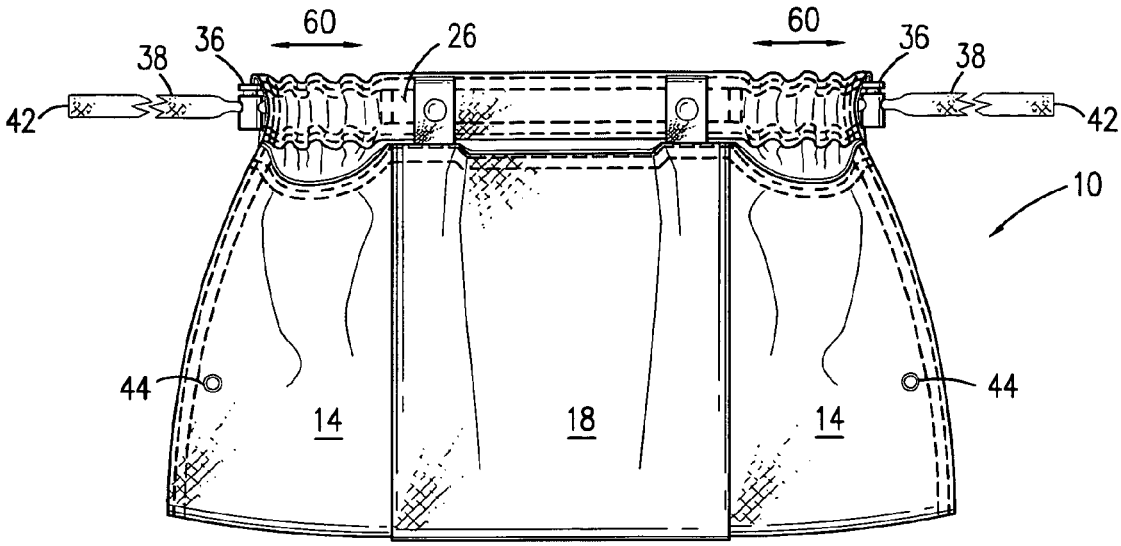
FIG. 8 is a front elevation view of the craft apron of FIG. 6 shown adjusted in width.

A cord lock 36 is provided on tie 38 for slidably adjusting a width of the craft apron 10 by gathering the hem 26 in a direction as indicated by arrows 60 as best seen in FIGS. 8 and 9.

Figure 3:
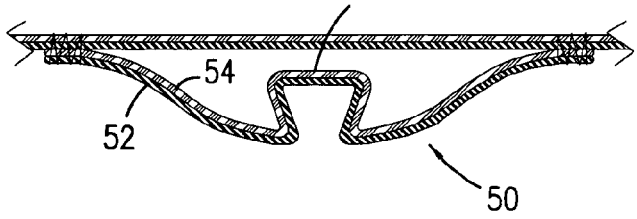
FIG. 3 is a top plan view of the craft apron of FIG. 1 taken on the line 3-3 showing a pocket and a pleat on the pocket.

Although not needed for operation, to make craft apron 10 even more useful, a pocket 50 having an outer pocket panel 52 and an inner pocket panel 54 is provided. Pocket 50 is disposed on at least inner panel 22 of second member 20. Further, pocket 50 may also include a pleat 56 thereon as best seen in FIGS. 1 and 3. For reasons mentioned above, preferably, when pocket 50 is used, outer pocket panel 52 may be fabricated from a low friction material such as, for example, satin, and inner pocket panel 54 may be fabricated from a cotton material.

Figure 2:
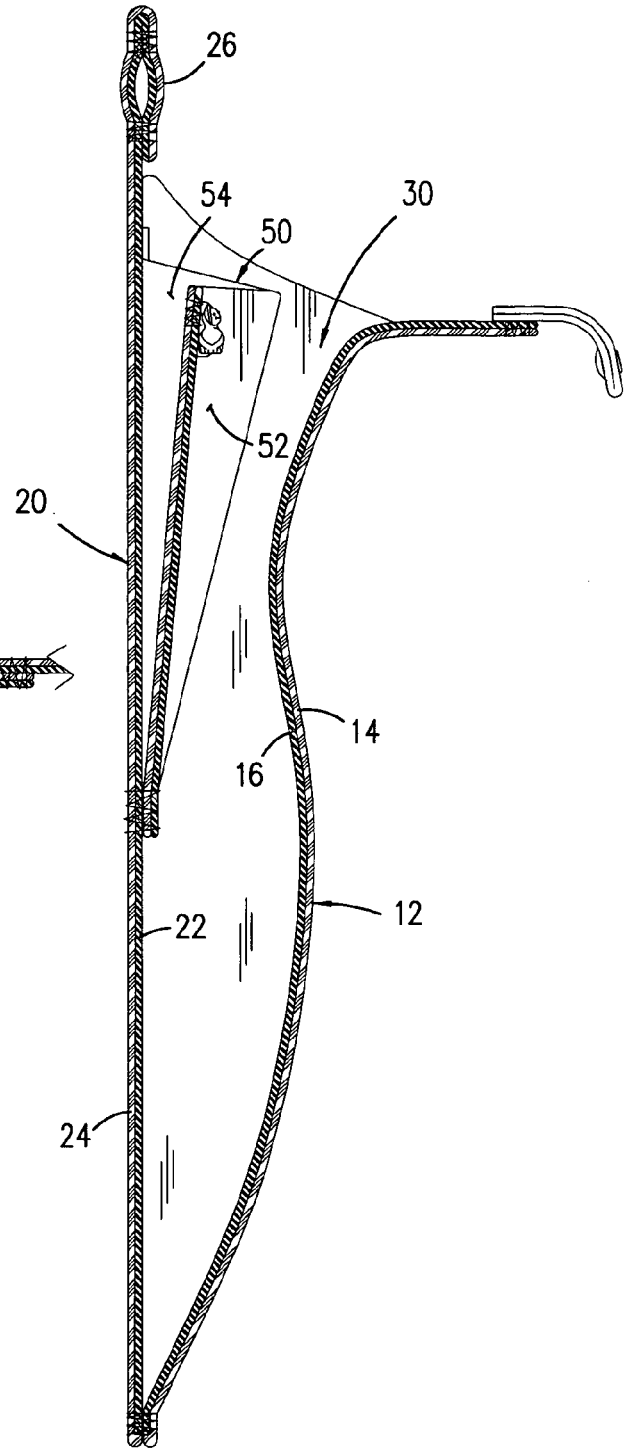
FIG. 2 is an enlarged sectional view of the craft apron of FIG. 1 taken on the line 2-2.

FIG. 2 is an enlarged sectional view of craft apron 10 of FIG. 1 taken on the line 2-2 and shows construction details for hem 26, pouch 30, pocket 50, first member 12 and second member 20.

FIG. 3 is a top plan view of craft apron 10 of FIG. 1 taken on the line 3-3 showing pocket 50, outer pocket panel 52, inner pocket panel 54 and pleat 56 on pocket 50.

Figure 4:
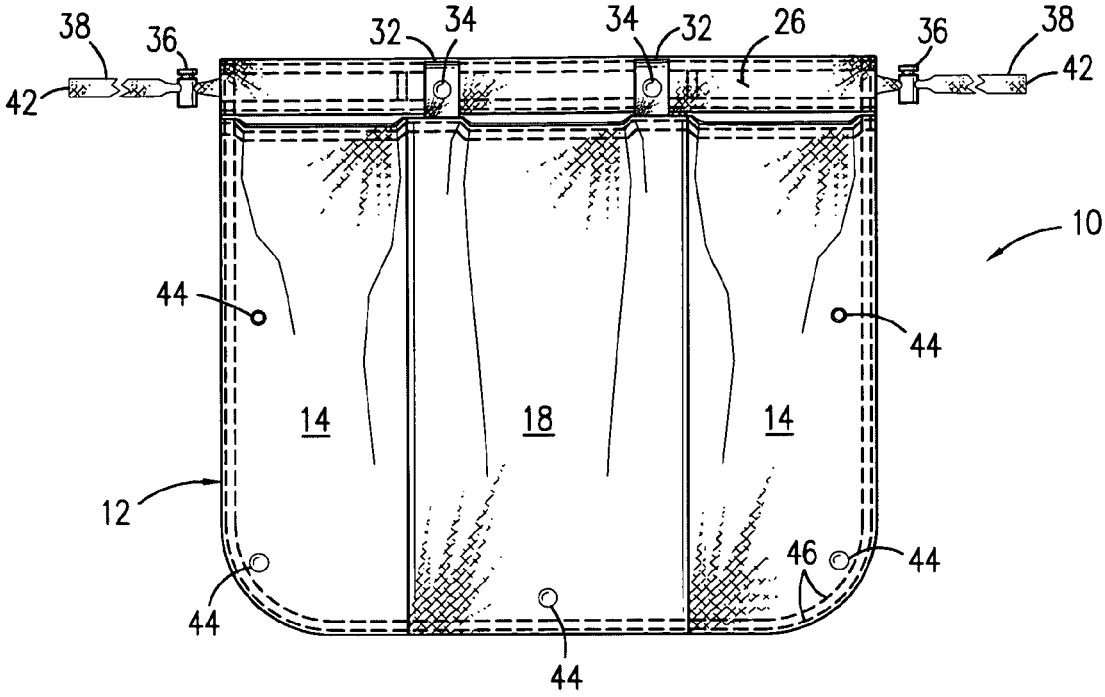
FIG. 4 is a front elevation view of the craft apron of FIG. 1 in a closed position.

FIG. 4 is a front elevation view of craft apron 10 of FIG. 1 in a closed position.

Figure 5:
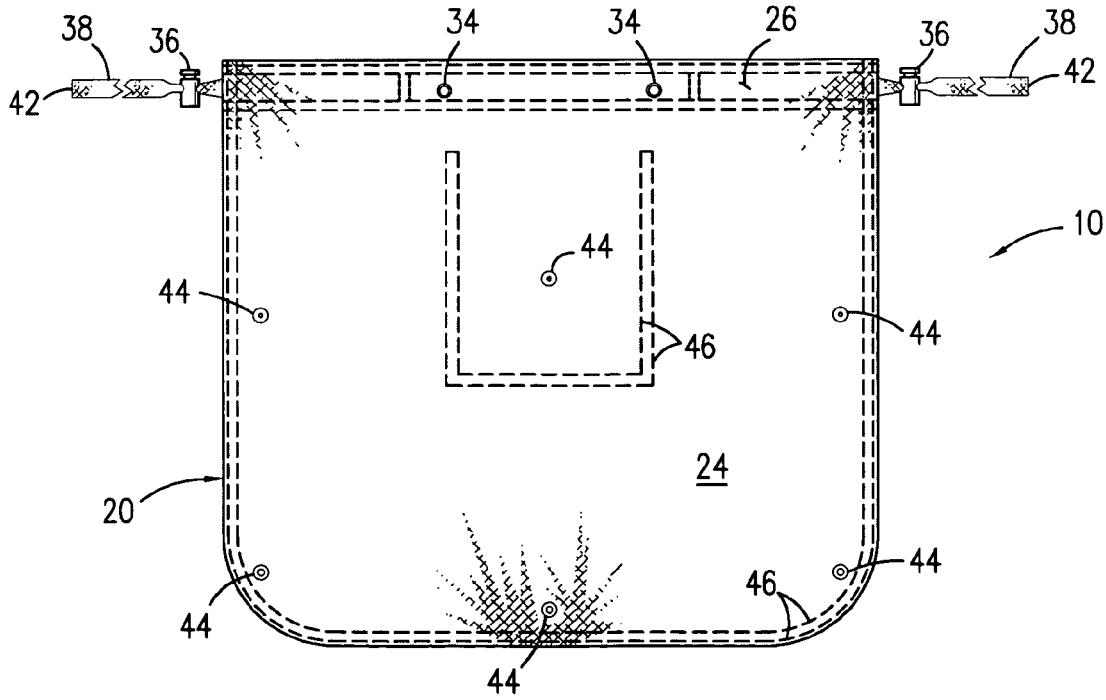
FIG. 5 is a rear elevation view of the craft apron of FIG. 4.

FIG. 5 is a rear elevation view of craft apron 10 of FIG. 4.

FIG. 6 is a front elevation view of craft apron 10 of FIG. 4 shown shortened in length. The means for adjusting a length of craft apron 10 is by use of snap fastener 44.

FIG. 7 is a rear elevation view of craft apron 10 of FIG. 6.

FIG. 8 is a front elevation view of craft apron 10 of FIG. 6 shown adjusted in width. The means for adjusting a width of craft apron 10 is by use of cord lock 36 and the width adjusting means cooperating with tie 38.

FIG. 9 is a front elevation view of craft apron 10 of FIG. 8 shown with tie 38 distal ends 42 joined for carrying as a tote bag or for use as an apron around a waist of a crafter.

It is understood that craft apron 10 may be fabricated from readily available materials including, but not limited to, a material chosen from the group consisting of satin, silk, polyester, nylon, rayon, acetate, acrylic, latex, cotton, wool, linen, jute, hemp, leather and ramie. Various styles and sizes of fasteners are commercially available including a snap fastener, a hook and loop type fastener, a button with a button hole and a magnet, any one of which may be used in constructing craft apron 10 without departing from this disclosure. Standard assembly methods such as sewing are employed in constructing craft apron 10.

First member 12 having pleated portion 18 and second member 20 having hem 26 are constructed from the above materials. Second member 20 is joined to first member 12 to define pouch 30. A closure 32 disposed on first member 12 and means for removably fastening the closure 32 to hem 26 are provided. Tie 38 is placed into hem 26. Means for adjusting a width of craft apron 10 cooperating with tie 38 and with hem 26; and means for adjusting a length of craft apron 10 are provided.

In use, a crafter places their craft project and materials into craft apron 10 and the crafter works directly therefrom. Craft apron 10 may be worn about the waist or handily carried as a tote bag, thereby always having the craft project and craft materials close at hand. The craft apron 10 can be readily adjusted in both width and length to suit any crafter's needs.

EXAMPLE

The inventor has recognized a need and has solved a heretofore unaddressed problem in the prior art in creating an adjustable craft apron 10. Craft apron 10 was fabricated from cotton and satin material and has been reduced to practice, according to the teachings of this invention and tested with good results. The cotton material had a Koala Bear decorative pattern thereon. For added flair, an ornamental Koala Bear ornament was sewn onto pleat 56 on pocket 50 thereby making an attractive, yet highly functional, craft apron 10. The strategically disposed low friction material, satin in this case, allowed the yarn to be freely dispersed from the pouch 30 without fuzzing or pilling the skein of yarn or the yarn work itself. The inventor recognized that a wide variety of materials, patterns and themes can be utilized in constructing the craft apron 10, as desired by a crafter, including personalization.

Surprisingly, the instant invention provides an added advantage and recognizes a problem and adequately and completely addresses an unfulfilled need, in that craft apron 10 in the manner disclosed, in effect, defines a highly functional and useful apparatus that is not presently available. This is due entirely to the particular way the inventor designed and fabricated the craft apron 10 disclosed herein which are not found or taught in the prior art. By doing so, the inventor was able to use inexpensive materials in the fabrication without sacrificing performance, rather, achieving superior unexpected results, due to the particular construction which is cost effective.

One practical advantage of the invention is that it provides a convenient, practical, low cost, craft apron 10 which allows a user to conveniently, and in an efficient manner, work on and store a craft project thereby preventing it from being separated and always being close at hand regardless of exterior influences. Another advantage is the capability of being able to readily convert craft apron 10 into a tote bag. Another advantage is that craft apron 10, unlike other bags, can be adjusted to fit any user. Still another advantage is that craft apron 10 is designed for ease of manufacture by standard methods such as by sewing and by using readily available materials particularly chosen for the problem solved.

Of course, a wide variety of further uses and advantages of the present invention will become apparent to one skilled in the art. As disclosed, it is apparent that one skilled in the art will realize that the foregoing discussion outlines the more important features of the invention to enable a better understanding of the instant invention and to instill a better appreciation of the inventor's contribution to the art. It must be clear that the disclosed details of construction, descriptions of geometry and illustrations of inventive concepts are mere examples of possible manifestations of the invention.

Although the invention has been shown and described with reference to certain illustrative embodiments, those skilled in the art undoubtedly will find alternative embodiments obvious after reading this disclosure. With this in mind, the following claims are intended to define the scope of protection to be afforded the inventor, and those claims shall be deemed to include equivalent constructions insofar as they do not depart from the spirit and scope of the present invention.

What is claimed is:

1. A craft apron comprising:

a first member having a pleated portion and a second member having a hem;

said second member joined to said first member to define a pouch;

a closure disposed on said first member;

means for fastening said closure to said hem;

a tie cooperating with said hem;

means for adjusting a width of said craft apron;

said width adjusting means cooperating with said tie; and means for adjusting a length of said craft apron.

2. The craft apron of claim 1 wherein said fastening means comprises a fastener disposed on said closure and on said hem.

3. The craft apron of claim 2 wherein said fastener is one of a snap fastener, a hook and loop type fastener, a button with a button hole and a magnet.

4. The craft apron of claim 1 wherein said width adjusting means comprises a cord lock slideably disposed on said tie.

5. The craft apron of claim 1 wherein said length adjusting means comprises a snap fastener disposed on said first member and on said second member.

6. The craft apron of claim 1 fabricated from a material chosen from the group consisting of satin, silk, polyester, nylon, rayon, acetate, acrylic, latex, cotton, wool, linen, jute, hemp, leather and ramie.

7. The craft apron of claim 1 further comprising a pocket disposed on at least an inner panel of said second member.

8. The craft apron of claim 7 wherein said pocket is pleated.

9. A craft apron comprising:

a first member having a front panel, a rear panel and a pleated portion and a second member having an inner panel, an outer panel and a hem;

at least said rear panel of said first member and at least said inner panel of said second member fabricated from a low friction material;

said second member joined to said first member to define a pouch;

a closure disposed on said first member;

a fastener disposed on said closure and on said hem for fastening said closure to said hem;

a tie having a proximal end and a distal end;

said tie cooperating with said hem;

means for adjusting a width of said craft apron;

said width adjusting means cooperating with said tie; and means for adjusting a length of said craft apron.

10. The craft apron of claim 9 wherein said fastener is one of a snap fastener, a hook and loop type fastener, a button with a button hole and a magnet.

11. The craft apron of claim 9 wherein said proximal end of said tie enclosed and fixed therein a portion of said hem and said distal end of said tie freely extending outwardly therefrom.

12. The craft apron of claim 9 wherein said proximal end of said tie and said distal end of said tie freely extending outwardly therefrom said hem.

13. The craft apron of claim 9 wherein said width adjusting means comprises a cord lock slideably disposed on said tie.

14. The craft apron of claim 9 wherein said length adjusting means comprises a snap fastener disposed on said first member and on said second member.

15. The craft apron of claim 9 further comprising a pocket having at least an outer pocket panel with a low friction material and an inner pocket panel and said pocket disposed on at least an inner panel of said second member.

16. The craft apron of claim 15 wherein said pocket is pleated.

17. A method for fabricating a craft apron comprising the steps:

selecting a material chosen from the group consisting of satin, silk, polyester, nylon, rayon, acetate, acrylic, latex, cotton, wool, linen, jute, hemp, leather and ramie;

fabricating a first member having a pleated portion and a second member having a hem from said material;

joining said second member to said first member to define a pouch;

providing a closure disposed on said first member;

providing means for removably fastening said closure to said hem;

providing a tie;

placing said tie into said hem;

providing means for adjusting a width of said craft apron cooperating with said tie and with said hem; and providing means for adjusting a length of said craft apron.

18. The method for fabricating a craft apron of claim 17 further comprising the step of providing a pocket having at least an outer pocket panel with a low friction material.

19. The method for fabricating a craft apron of claim 18 further comprising the step of disposing said pocket on at least an inner panel of said second member.

20. The method for fabricating a craft apron of claim 19 further comprising the step of forming a pleat onto said pocket.

* * * * *